US005443261A

United States Patent [19]

Lee et al.

[11] Patent Number: 5,443,261

[45] Date of Patent: Aug. 22, 1995

[54] ARCADE TYPE OF TOY HAVING CLIMBING OBJECTS

[75] Inventors: James S. W. Lee, Long Island, N.Y.; Chiu K. Kwan, Kowloon, Hong Kong

[73] Assignee: C. J. Associates, Ltd., Hong Kong

[21] Appl. No.: 201,654

[22] Filed: Feb. 25, 1994

[51] Int. Cl.[6] ..... A63F 9/14

[52] U.S. Cl. ..... 273/86 R; 273/86 F; 273/440; 273/445

[58] Field of Search ..... 273/85 R, 86 R, 86 B, 273/86 D, 86 F, 445, 440

[56] References Cited

U.S. PATENT DOCUMENTS

| | | | |
|---|---|---|---|
| 1,454,968 | 5/1923 | Higuchi | 273/86 F |
| 3,423,091 | 1/1969 | Miller | 273/86 F |
| 3,572,712 | 3/1971 | Vick | 273/86 F |
| 3,815,912 | 6/1974 | Wichinsky et al. | 273/86 F |
| 3,827,693 | 8/1974 | Barlow et al. | 273/86 F |
| 3,999,758 | 12/1976 | Reitzel | 273/86 D |

FOREIGN PATENT DOCUMENTS

| | | | |
|---|---|---|---|
| 2119262 | 11/1983 | United Kingdom | 273/86 F |

*Primary Examiner*—Vincent Millin
*Assistant Examiner*—William M. Pierce
*Attorney, Agent, or Firm*—Laff, Whitesel, Conte & Saret

[57] ABSTRACT

A toy arcade game has a plurality of spaced parallel vertical tracks. A moving object (here a monkey) is mounted on each track to drop under gravity to the bottom of the track. An endless belt drives the object up the track. If a push button is pressed quickly enough, the object drops back to the bottom. It is not pushed quickly enough the object reaches the top of its climb. The object of the game is to push the buttons quickly enough to keep any of the objects from reaching to top of the track.

21 Claims, 2 Drawing Sheets

Fig. 1
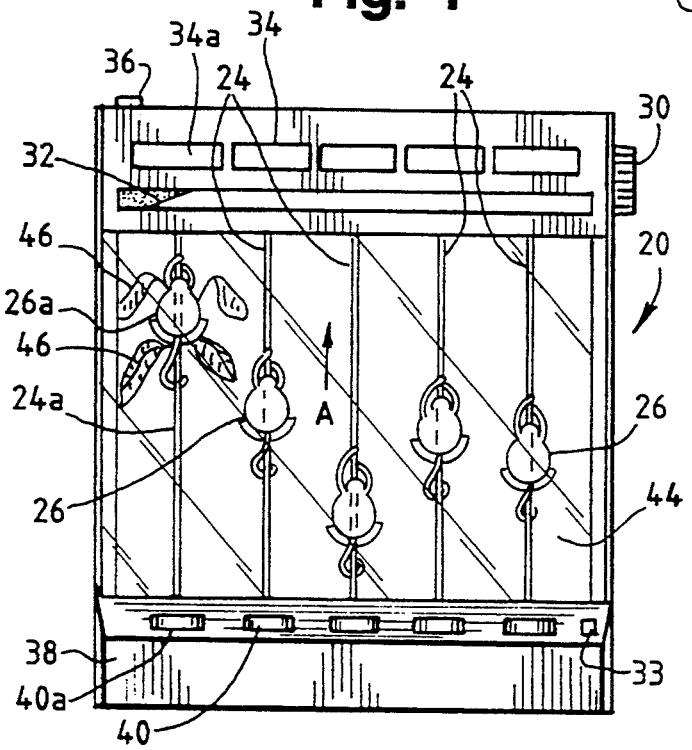
Fig. 2
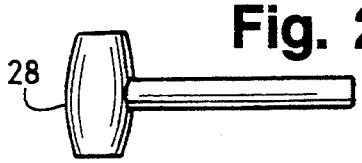
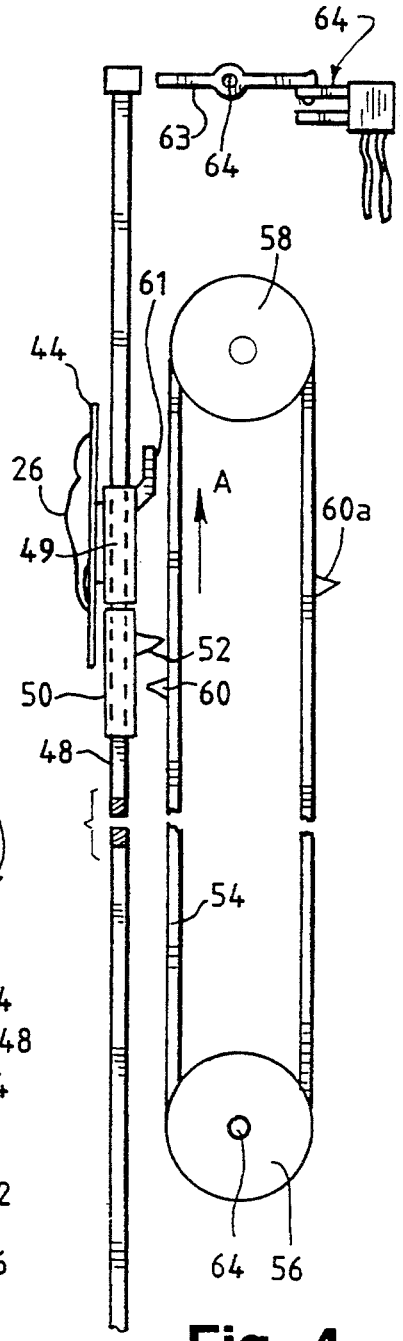
Fig. 4
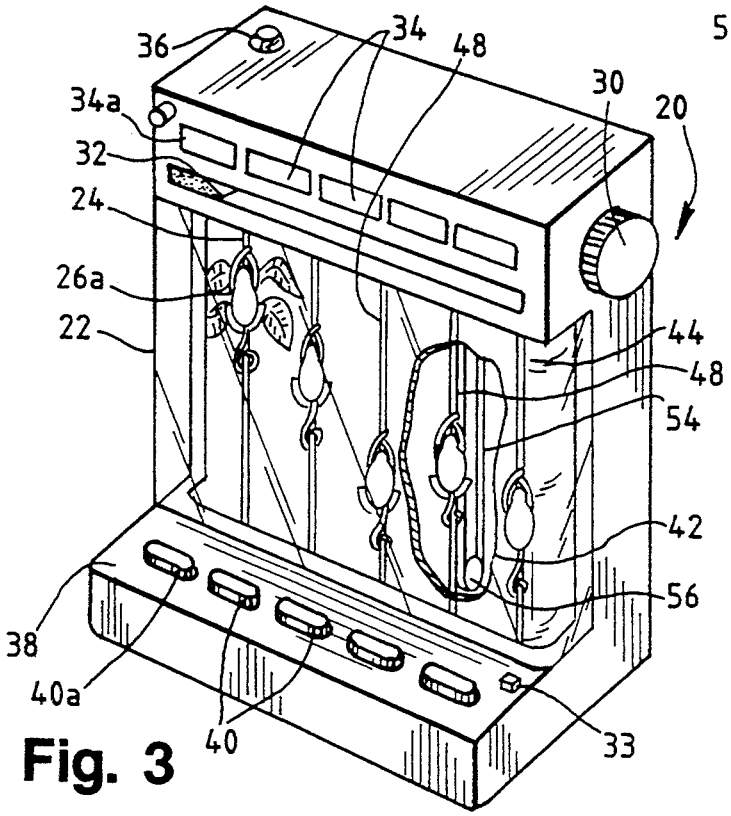
Fig. 3

Fig. 6
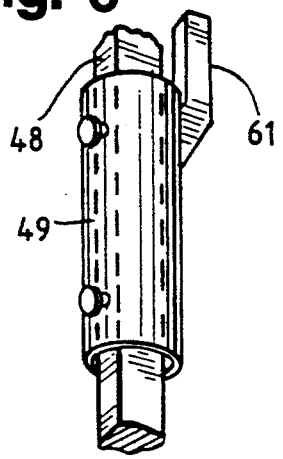
Fig. 7
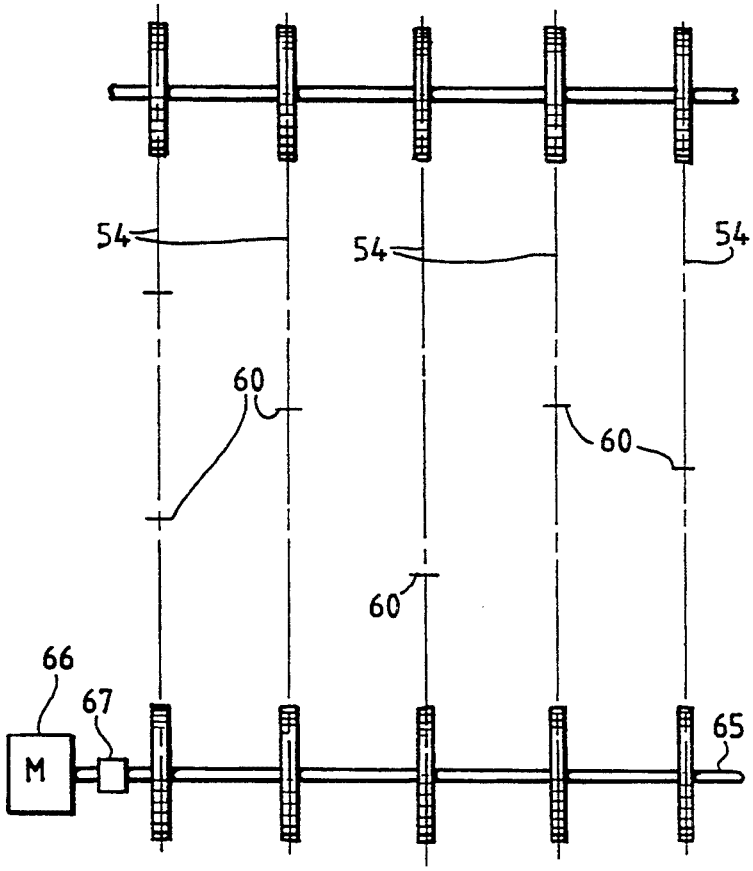
Fig. 5
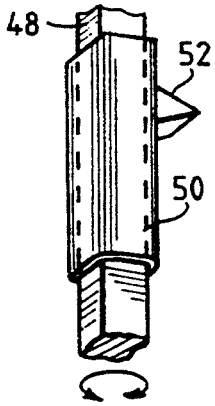
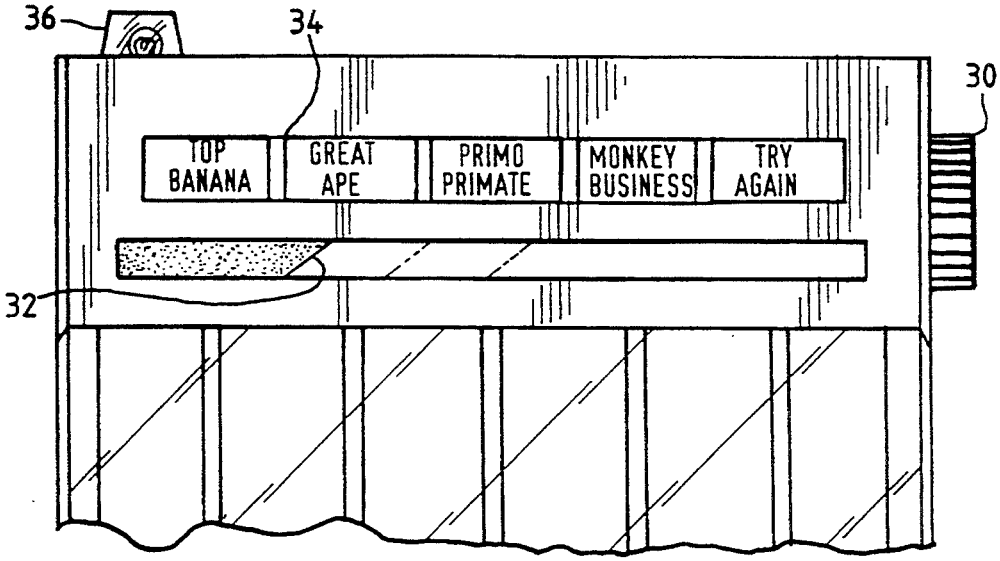
Fig. 8

ARCADE TYPE OF TOY HAVING CLIMBING OBJECTS

BACKGROUND OF THE INVENTION

This invention relates to toys and more particularly to toys simulating arcade types of games, especially toys which may be controlled by a slap of the hand or a blow of a hammer and for use in a family environment.

Generally, arcade games are fairly large, heavy, and expensive machines which permit a person to manipulate controls in order to accumulate a score and compete with other players, for example. Examples of such arcade games are pinball machines, pachinko, computerized simulations of war games or sports events, for example.

These machines are found in places such as public rooms, or restaurants, primarily because they are too expensive and occupy too much space for the average home. Nevertheless, people would like to have them in a convenient environment, such as the home, for family entertainment. This is especially true when children are involved. Their parents want to know both where they are and that they are out of harm's and temptation's way.

SUMMARY OF THE INVENTION

To fill this need, the arcade game machine simulating toy should sell at a very low cost, should be light enough to carry easily, and should not occupy too much room. It should be easy enough to play for a child to become an accomplished player. Still, it should be challenging enough for a youth, parents, or adults to find of interest, especially when playing with a child.

Accordingly, an object of the invention is to provide toys and games of the described type with new and novel forms of play. Here, an object is to provide an arcade game simulating toy which may be made in a great variety of different ways. In this connection, an object is to make both simple games which a child can play by a slap of a hand or a hammer, and more complex games requiring a higher level of hand and eye coordination.

In keeping with an aspect of this invention, these and other objects are accomplished by providing a box which is visually open to inspection on at least one side. A transparent panel covers the open side of the box. The background behind the transparent panel may include any graphics or objects appropriate to the game. Controls on the front of the box enable the player to manipulate objects behind the transparent panel. Thus, for example, the arrangement might be a toy or machine which has a number of monkeys which are trying to climb to the top of coconut trees. If a push button can be pushed before the monkey reaches a top of the tree, the monkey falls back. If the monkey reaches the top of a tree, he wins, a light lights, and a count may be stored to eventually record a game total.

DESCRIPTION OF THE DRAWINGS

A preferred embodiment of the invention is shown in the attached drawing in which:

FIG. 1 is a front elevation view showing an example of an inventive game featuring five monkeys climbing five tree;

FIG. 2 is a side elevation view of a hammer or mallet;

FIG. 3 is a perspective view which shows the toy of FIG. 1;

FIG. 4 is a schematic elevation view, showing the inner working of the toy;

FIG. 5 is a fragmentary view which shows a rail with a square cross section, which may rotate to control the monkey's climb;

FIG. 6 shows the same rail which does not rotate in order to carry the monkey;

FIG. 7 schematically shows five spaced parallel belts for transporting the monkeys of FIGS. 1 and 3; and FIG. 8 shows a scoring mechanism which displays the number of scores made by monkeys which reach the top of a tree.

DESCRIPTION OF THE PREFERRED EMBODIMENT

In FIGS. 1 and 3, a box 20 has an open front which reveals inside surfaces of the box. A transparent panel 22 covers the open side of the box. As here shown, there appears to be five coconut trees 24, each of which has a monkey 26 climbing it. Beneath each tree 24 is a push button 40 which may be slapped or struck with a hammer or mallet 28. (FIG. 2). A suitable, rotating scroll display is also turned by knob 30 in order to display a color edge 32 which moves when a monkey reaches the top of his climb to indicate how many points the player loses.

Above each "tree" 24 is a suitable display 34 which may serve any suitable function. As here shown (FIG. 8), there are five scores ranging from "top banana" when no monkey reaches the top of a tree to "try again" when too many monkeys reach the top. The display 34 shows different scoring levels and could also light a suitable lamp 36 when and if the individually monkey reaches the top of its tree. If a counter is provided, it could display a game score.

A start switch 33 (FIGS. 1, 3) is pressed to start an internal thirty second, for example, timer of any suitable design. When the switch 33 is pushed, the monkeys 26 begin climbing their trees 24. There may be an adjustment to the speed at which the monkeys climb in order to provide different skill levels.

At a control panel 38 beneath each "tree" 24 is a push button control 40. For example, push button **40*a* is individually associated with monkey 26*a* and "tree" 24*a***.

The object of the game is to strike the push button 40 before the associated monkey reaches the top of the tree. The climbing monkey drops to the ground as soon as its push button is pressed. Then the monkey begins to climb again.

The mechanism for causing the monkeys to climb is seen in a broken away part 42 of FIG. 3 and in FIGS. 4, 7. In greater detail, each "tree" is a slot in a front surface panel 44 of the box 20. There may be graphics associated with each slot in order to create interest. For example, palm leaves 46 (FIG. 1 )are shown in association with a first slot **24*a* in order to suggest that the monkey 26*a*** is climbing a coconut tree.

The mechanism which makes the monkey climb the tree is seen in FIGS. 3, 4, 7. There is a metal rail 48 having a non-circular preferable square, cross section beneath each slot 24. The monkey 26 is mounted on a plastic part 49 which fits through slot 24 and slides freely on the rail 48. Another plastic part 50 is also mounted on and slides freely over rail 48. The difference is that part 50 (FIG. 5) rotates with a rotation of rail 48 in order to rotate a tab 52, while the part 49 (FIG. 6) supporting the monkey does not rotate with the rail. In the non-rotated position, tabs 52, 60 are coupled in a mutual engagement. In the rotated position (not shown) tabs 52, 60 do not touch each other, so that tab 60 moves past tab 52 with no effect.

Adjacent each rail 48 is an endless belt 54 trained around a pair of pulley wheels 56, 58. The belt 54 has one or more upstanding tabs 60 attached thereto. As the belt runs (in direction A), a tab 60 engages the lowered tab 52 associated with the monkey 26. Thus, as the belt moves in direction A (FIGS. 1 and 4), the monkey 26 climbs the tree 24.

Upon the turning of tab 52 when rail 48 rotates, the monkey 26 drops under gravity to the bottom of the tree. In greater detail, if the player strikes the push button 40 individually associated with a particular monkey, the rail 48 rotates and that monkey's tab 52 is rotated along with part 50 to disengage tab 52 from tab 60. Tab 60 is driven passed tab 52 responsive to the power from the motor applied through belt 54, thus, causing the monkey to drop to the bottom of the tree (slot 24). If the push button 40 is not pushed quickly enough, rail 48 does not rotate, and the monkey 26 reaches the top of its climb, light 36 lights (FIG. 1), perhaps drives a counter. That is, when the monkey reaches the top of its climb, an actuator finger 61 on part 49 pushes an arm 63 which pivots around point 64 to close contacts 64 which lights lamp 36.

As the endless belt 54 goes around pulley wheel 58, belt tab 60 disengages the monkey tab 52. The monkey 26 drops to the bottom of the tree. Actuator finger 61 leaves arm 63, which returns to normal under a spring bias. Contacts 64 open and lamp 36 goes dark.

As soon as the push button 40 is released, the rail 48 rotates back to its normal position in response to a spring bias. The tab 52 is engaged by the next oncoming tab 60*a* and the monkey again begins to climb the tree.

Since there are five slots 24, there are five endless belts 54 (FIG. 7), all having a pulley mounted on and driven from a common shaft 65 which, in turn, is driven by a motor 66 via gear box 67.

In operation, a slide button which is located on the back of box 20 is manipulated to select a skill level by changing gear rates at gear box 67 in order to run at a selected speed. The smaller the gear ratio, combination, the faster the monkeys climb, which increases the required player skill level.

The knob 30 is turned to reset the score board 32, 34. All of the buttons 40 are pressed to drop the monkeys to the bottoms of their trees. Then a start button 33 is operated to start a thirty second time.

The monkeys immediately begin to climb the trees. The player begins hitting the push buttons 40 with hammer 28 to cause the monkeys to fall to the ground. If any monkey reaches the top of its climb, a light 36 lights, the scroll turns to advance line 32, and tab 60 is forced to pass tab 52 as the motor 66 drives the best around pulley wheel 58. The monkey drops to the base of the tree and tab 52 couples with the next tab 60 on the associated endless belt 54. The monkey begins to climb as soon as the next belt tab 60 encounters the monkey tab 52.

A suitable counter may be operated each time that the light 36 lights in order to keep a game score. This score may be displayed in a window of scroll 32, as well as with a coordination of display 34.

Those who are skilled in the art will readily perceive how to modify the invention. Therefore, the appended claims are to be construed to cover all equivalent structures which fall within the true scope and spirit of the invention.

The claimed invention is:

1. A toy arcade game comprising a housing having at least one transparent side, a plurality of spaced parallel tracks positioned behind said transparent side, a plurality of objects, each of said objects movably associated with one of said tracks, means associated with each of said objects for engaging said object with the associated track to move said object in a forward climbing direction along said track, means for disengaging said object from its associated track, and means for re-engaging said object with its associated track, whereby the object of the game is to prevent said climbing objects from reaching an end of their climb.

2. The toy of claim 1 and means for signaling each arrival of an object at the end of its climb.

3. The toy of claim 2 and means for measuring a period of time during which said objects climb and during which a player may cause them to disengage whereby the object of the game is to allow the fewest successful climbs to the ends of the tracks during said measured time period.

4. The toy of claim 1 wherein each of said tracks comprise a rotatable vertical rail having a non-circular cross section, said engaging means including an endless belt trained over at least two pulleys, said belt being substantially parallel to said rail, at least one upstanding tab on said belt, at least one tab on said object for engaging said tab on said belt, means for rotating said tab on said object to engage and be driven by or to disengage and be released from said tab on said belt, said disengaging means comprising a rotation of said rail and said tab on said object, and means for driving said endless belt.

5. The toy of claim 4 wherein there are a plurality of said upstanding tabs on each of said belts.

6. The toy of claim 5 wherein there are a plurality of said endless belts, and said rotating means rotates said tab on said object in response to a completion of said drop, whereby the next tab on said endless belt engages said tab from said object to cause it to climb again.

7. The toy of claim 4 and a push button individually associated with each of said tracks, and means responsive to an operation of each push button for causing each rail associated with said tracks and said tab on the object to rotate out of engagement with said tab on said belt.

8. The toy of claim 7 wherein each of said push buttons is an upstanding member which is operated responsive to a hammer blow.

9. The toy of claim 4 wherein said object has two parts which move together, one of said parts carrying said tab on said object and rotating with said rail, and the other of said tabs carrying said object and not rotating with said rail.

10. A toy comprising a housing having a transparent front panel, a plurality of spaced parallel vertically arranged endless belts trained over pairs of pulleys, one of said pulleys of each of said pairs being mounted on and turning with a common shaft so that all of said belts are driven simultaneously, a motor for rotating said shaft in order to drive said belts, a plurality of rotatably mounted rails having a non-circular cross section and being individually associated with and in a spaced parallel relationship with each of said endless belts, an object including two parts slidably mounted on each rail to fall under gravity, one of said two parts rotating with said rail, the other of said two parts not rotating with said rail, tabs on said belts and on the one of the parts of the objects which rotate with said rail, the tabs on the belt and on the one part intercoupling to cause said objects to move with said driven belts, whereby said belt causes said objects to move up said rails, and means for selectively rotating a rail and decoupling one of said intercoupled tabs so that the object associated with said decoupled tab falls under gravity, said decoupled tab returning from said decoupled position responsive to said fall in order to restore said decoupled tab to intercouple the tabs on said object and said belt.

11. The toy of claim 10 wherein said decoupled tab is on said object and there are a plurality of tabs on each of said belts so that after said return of said decoupled tab, said belt almost immediately causes said object to again move up said rail.

12. The toy of claim 11 wherein there is a panel with a plurality of spaced parallel slots between said rails and said objects, said object being mounted on said associated rail via the other of said parts which does not rotate with said rail, and via an individually associated one of said slots, said objects but not said rails being seen through said transparent panel.

13. The toy of claim 12 and a push button individually associated with each of said rails, means responsive to an actuation of any one of said push buttons for rotating the associated rail to decouple the tab of the object mounted on the rail individually associated with the actuated push button.

14. The toy of claim 13 wherein said push buttons are configured to be operated by hammer blows, said rail being rotated when said push button is depressed and restored from said rotation when said push button is released.

15. The toy of claim 14 and means for selecting a skill level by adjusting the speed at which said motor drives said belts.

16. A toy arcade game comprising a housing having at least one transparent side, a plurality of spaced parallel tracks positioned behind said transparent side, means comprising an object individually associated with each of said tracks for moving along its individually associated track in a forward climbing direction, means associated with said housing and each of said tracks for causing individual ones of said objects to drop from its climb to a lower end of its associated track, and means for causing said dropped object to again start its forward climb, wherein each of said tracks comprise a rotatable vertical rail having a non-circular cross section, means for moving along the track including an endless belt trained over at least two pulleys, said belt being substantially parallel to said rail, at least one upstanding tab on said belt, at least one tab on said object for engaging said tab on said belt, means for rotating said tab on said object to engage and to be driven by or to disengage and be released from said tab on said belt, said means for causing said object to drop comprising a rotation of said rail and said tab on said object, and means for driving said endless belt, whereby the object of the game is to prevent said climbing objects from reaching an end of their climb.

17. The toy of claim 16 wherein there are a plurality of said upstanding tabs on each of said belts.

18. The toy of claim 17 wherein there are a plurality of said endless belts, and said rotating means rotates said tab on said object in response to a completion of said drop, whereby the next tab on said endless belt engages said tab on said object to cause it to climb again.

19. The toy of claim 16 and a push button individually associated with each of said tracks, and means responsive to an operation of each push button for causing each rail associated with said tracks and said tab on the object to rotate out of engagement with said tab on said belt.

20. The toy of claim 19 wherein each of said push buttons is an upstanding member which is operated responsive to a hammer blow.

21. The toy of claim 16 wherein said object has two parts which move together, one of said parts carrying said tab on said object and rotating with said rail, and the other of said tabs carrying said object and not rotating with said rail.

* * * * *